US009517878B2

(12) United States Patent
Broekhuizen

(10) Patent No.: US 9,517,878 B2
(45) Date of Patent: Dec. 13, 2016

(54) FLEXIBLE WRAPPING MATERIAL FOR WRAPPING FLOWERS AND/OR PLANTS

(71) Applicant: Koen Pack B.V., Amstelveen (NL)

(72) Inventor: Koenraad Jacobus Broekhuizen, Amstelveen (NL)

(73) Assignee: Koen Pack B.V., Amstelveen (NL)

( * ) Notice: Subject to any disclaimer, the term of this patent is extended or adjusted under 35 U.S.C. 154(b) by 0 days.

(21) Appl. No.: 14/745,434

(22) Filed: Jun. 21, 2015

(65) Prior Publication Data

US 2015/0368030 A1 Dec. 24, 2015

(30) Foreign Application Priority Data

Jun. 24, 2014 (NL) ..... 2013062

(51) Int. Cl.

| | |
|---|---|
| ***B65D 65/00*** | (2006.01) |
| ***B65D 85/50*** | (2006.01) |
| ***B65D 65/04*** | (2006.01) |
| ***B65D 65/12*** | (2006.01) |
| *B65D 65/18* | (2006.01) |
| *B65D 85/52* | (2006.01) |

(52) U.S. Cl.

CPC ..... *B65D 85/505* (2013.01); *B65D 65/04* (2013.01); *B65D 65/12* (2013.01); *B65D 65/18* (2013.01); *B65D 85/52* (2013.01); *B65D 2565/381* (2013.01)

(58) Field of Classification Search

CPC ..... B65D 85/505; B65D 65/04; B65D 65/12; A47G 7/00; A47G 7/02

USPC ..... 229/87.01, 405, 87.06; 206/423

See application file for complete search history.

(56) References Cited

U.S. PATENT DOCUMENTS

| | | | | |
|---|---|---|---|---|
| 1,863,216 A * | 6/1932 | Wordingham | ..... | B65D 75/04 206/284 |
| 2,047,980 A | 7/1936 | Olm et al. | | |
| 2,171,484 A * | 8/1939 | Squire | ..... | A47J 31/08 210/497.2 |
| 6,665,982 B1 * | 12/2003 | Van Wingerden | ..... | A01G 5/04 206/423 |

(Continued)

FOREIGN PATENT DOCUMENTS

| | | |
|---|---|---|
| DE | 69203237 | 2/1996 |
| GB | 2496391 | 5/2013 |

(Continued)

OTHER PUBLICATIONS

Translation of NL 1033166.*

(Continued)

*Primary Examiner* — Jes F Pascua

(57) ABSTRACT

Flexible wrapping material for wrapping flowers and/or plants, wherein at least two connected parts having mutually distinctive shapes border next to each other along a straight line separating said parts from each other. Optionally said parts are provided with mutually distinctive prints on said parts. In another embodiment said parts are embodied in mutually different materials. It is suitable that one part is embodied in a plastic material and the other part is embodied in a woven or nonwoven fabric material. Neighboring edges of adjacent parts are sealed to each other. Sealing can be achieved in many ways, for instance by heating or by ultrasonic sealing.

5 Claims, 2 Drawing Sheets

(56) References Cited

U.S. PATENT DOCUMENTS

| | | | | |
|---|---|---|---|---|
| 6,735,925 | B2 * | 5/2004 | Weder | A47G 7/085 493/408 |
| 7,396,320 | B2 * | 7/2008 | Tchira | B65D 65/12 206/423 |
| 2004/0031197 | A1 | 2/2004 | Weder | |
| 2005/0082353 | A1 * | 4/2005 | Tchira | B65D 65/12 229/87.01 |
| 2005/0085365 | A1 * | 4/2005 | Tchira | B65D 65/12 493/231 |
| 2006/0054521 | A1 | 3/2006 | Tchira | |

FOREIGN PATENT DOCUMENTS

| | | |
|---|---|---|
| NL | 1033166 | 2/2008 |
| NL | 1035902 | 3/2010 |
| WO | WO 2005/042378 | 5/2005 |

OTHER PUBLICATIONS

International Search Report and the Written Opinion Dated Mar. 4, 2015 From the European Patent Office Re. Application No. NL2013062 and Translation of Written Opinion in English.

* cited by examiner

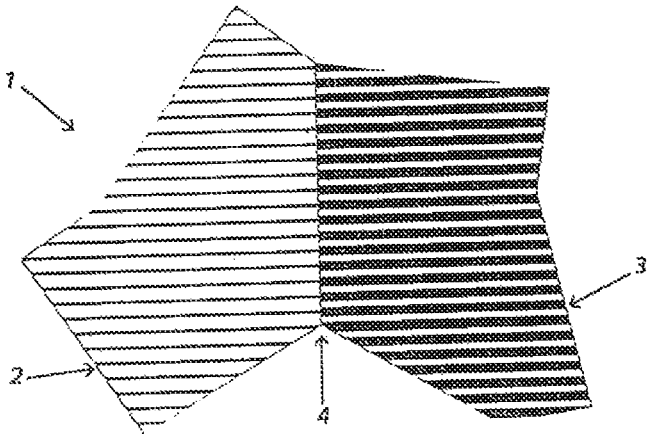
FIG. 1A
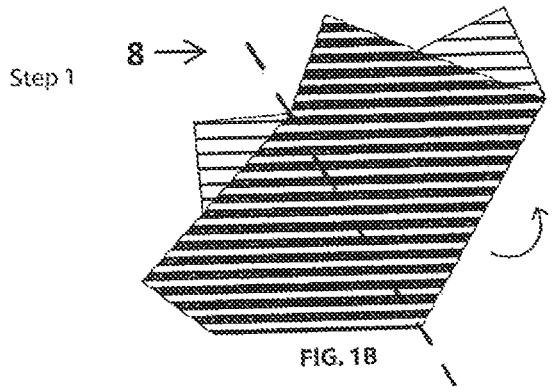
FIG. 1B
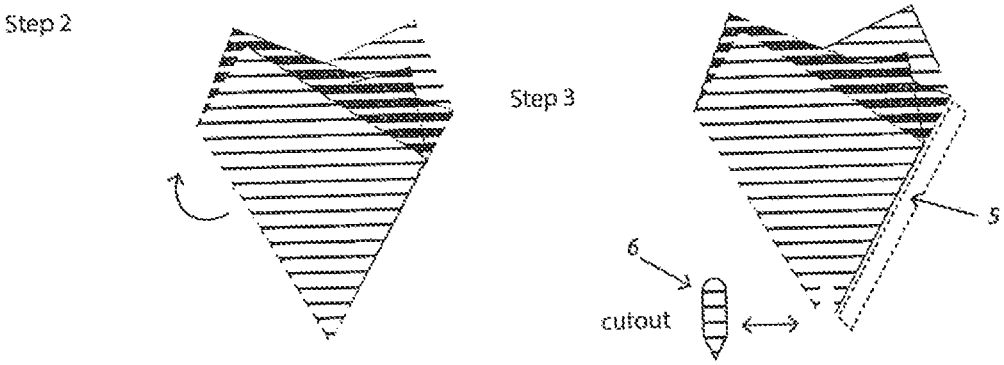
FIG. 1C
FIG. 1D

FLEXIBLE WRAPPING MATERIAL FOR WRAPPING FLOWERS AND/OR PLANTS

RELATED APPLICATION

This application claims the benefit of priority of Netherlands Patent Application No. 2013062 filed Jun. 24, 2014, the contents of which are incorporated herein by reference in their entirety.

FIELD AND BACKGROUND OF THE INVENTION

The invention relates to flexible wrapping material for wrapping flowers and/or plants.

Such flexible wrapping material is known from EP-B-1 678 057. This known flexible wrapping material is embodied as a sheet comprising a plurality of scored intersecting lines, and is movable from a first unfolded position into a second folded position by folding along the plurality of scored intersecting lines in a predefined sequence, wherein after the folding is completed the wrapping material forms a package with a predetermined shape having a decorative, hand-wrapped appearance.

US2006/0054521 and GB-A-2 496 391 each disclose a wrapping material for wrapping flowers and/or plants, comprising at least two connected parts having mutually distinctive shapes bordering next to each other along a straight line separating said parts from each other. The wrapping material of US2006/0054521 is flexible, whereas in comparison the wrapping material of GB-A-2 496 391 is a carton and therefore relatively rigid.

SUMMARY OF THE INVENTION

It is an object of the invention to provide a flexible wrapping material with a preferably decorative, but in any case hand-wrapped appearance at lower costs of manufacturing, in an easier way and with less requirements as to its preparation and with reference to its manner of completion into a folded package with a more consistent end result compared to hand-wrapped production.

The flexible wrapping material of the invention has the features of one or more of the appended claims.

In a first aspect of the invention a flexible wrapping material for wrapping flowers and/or plants is proposed, comprising at least two connected or connectable parts having mutually distinctive shapes bordering next to each other along a straight line or region separating said parts from each other, wherein said parts are provided with mutually distinctive prints on said parts and/or said parts are provided with different optical properties and/or said parts are embodied in mutually different materials. When in this specification reference is made to connected parts, the wrapping material is unitary. When in this specification reference is made to connectable parts, the wrapping material is made up from two separate parts that are connected to each other, for instance by gluing or by otherwise known connection means such as sealing or taping. Such known ways of connecting two separate parts to each other are obvious to the skilled person and require no further elucidation. The irregular and different shapes of the connected or connectable parts form the root of the eventual hand-wrapped appearance of the wrapping material after its completion in wrapped form.

Desirably the at least two connected or connectable parts are foldable towards each other along said straight line or region, which straight line or region is arranged such that after folding the two connected parts together, said connected or connectable parts at least partly overlap each other. Preferably the shapes of the connected or connectable parts are distinctive so as to arrange that after their folding together, the parts only partly overlap.

The effect of the hand-wrapping appearance is particularly promoted by arranging that said parts are provided with mutually distinctive prints on said parts or with different optical properties, for instance one being translucent and the other not. In addition or instead of that it is also possible that said parts are embodied in mutually different materials. Suitably one part is for instance embodied in a plastic material and the other part is embodied in a woven or nonwoven fabric material.

To achieve best effects it is preferable that after the two connected or connectable parts are being folded against each other, said connected parts are further foldable by one or more further folds, each further fold occurring along a virtual line symmetrically dividing the wrapping material in a left part and a right part, wherein after the fold is completed said left part and said right part are adjacent to each other.

Preferably after completion of the final fold neighbouring edges of the adjacent left part and right part are sealed to each other so as to construct the final shape of the product.

Advantageously the wrapping material is provided with a cutout by removal of material of the connected parts, thus enabling that the flowers can be received in the package.

BRIEF DESCRIPTION OF THE SEVERAL VIEWS OF THE DRAWINGS

The invention will hereinafter be further elucidated with reference to the drawing of an exemplary embodiment of an apparatus according to the invention that is not limiting as to the appended claims.

In the drawings:

FIGS. 1A-1D show a first embodiment of flexible wrapping material and a series of processing steps for wrapping flowers and/or plants with the wrapping material of the first embodiment according to the invention.

Whenever in the figures the same reference numerals are applied, these numerals refer to the same parts.

DESCRIPTION OF SPECIFIC EMBODIMENTS OF THE INVENTION

Figure 2A:
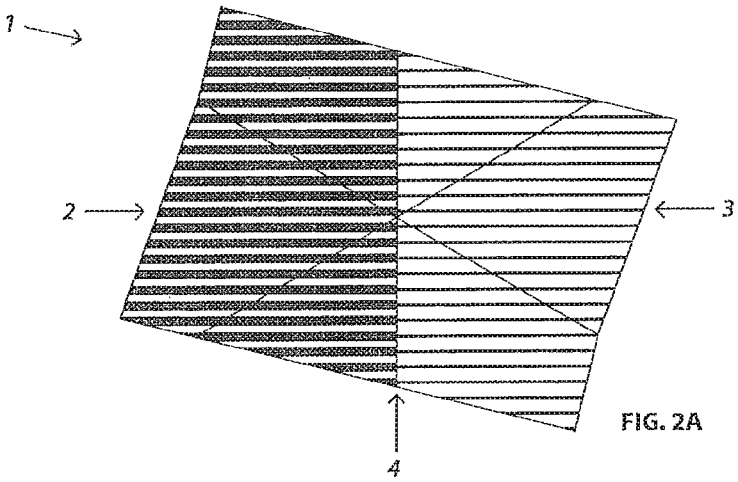
FIGS. 2A-2E show a second embodiment of flexible wrapping material and a series of processing steps for wrapping flowers and/or plants with the wrapping material of the second embodiment according to the invention.

Making reference to both FIG. 1A and FIG. 2A the flexible wrapping material for wrapping flowers and/or plants according to the invention is generally denoted with reference 1. The flexible wrapping material 1 can be a unitary cut from a larger sheet of a single material, or be obtained from several cuts in several materials. The flexible wrapping material 1 comprises at least two connected or connectable parts 2, 3 having mutually distinctive shapes bordering next to each other along a straight line or region 4 separating said parts 2, 3 from each other. Hence, when in this application reference is made to connected parts 2, 3, the wrapping material is made from a unitary cut of a single material. When in this application reference is made to connectable parts 2, 3, the wrapping material is made up from two separate parts that are made by several cuts in several materials that are afterwards connected to each other, for instance by gluing or by otherwise known means such as a sealing or taping. Such known ways of connecting two separate parts 2, 3 to each other are obvious to the skilled person and require no further elucidation.

The at least two connected or connectable parts 2, 3 are preferably foldable towards each other along said straight line or region 4, wherein said straight line or region 4 is arranged such that after their folding along said line or region 4, the two connected or connectable parts 2, 3 at least partly lie on top of each other or overlap. This is shown in FIG. 1B for the first embodiment of the wrapping material of the invention, and in FIG. 2B for the second embodiment of the wrapping material of the invention.

Figure 2B:
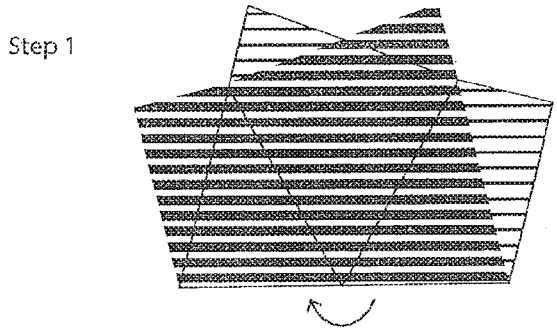

Both FIG. 1A and FIG. 2A are very clear in showing that the shapes of the connected parts 2, 3 are distinctive so as to arrange that after their folding together as shown in FIG. 1B and FIG. 2B respectively, the parts 2, 3 only partly overlap.

To support the distinction between the two parts 2, 3 said parts are for instance provided with mutually distinctive prints on said parts 2, 3. It is however also possible that said parts 2, 3 are embodied in mutually different materials or with different optical properties, such as one part translucent and the other part not translucent. When made of different materials one part, for instance part 2, is preferably embodied in a plastic material and the other part (part 3) is embodied in a woven or nonwoven fabric material. It can of course also be the other way around wherein part 2 is made from woven or nonwoven fabric material, and part 3 is a plastic material.

Figure 2C:
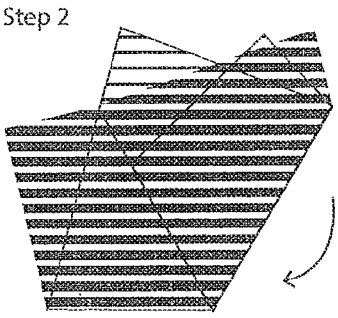
Figure 2D:
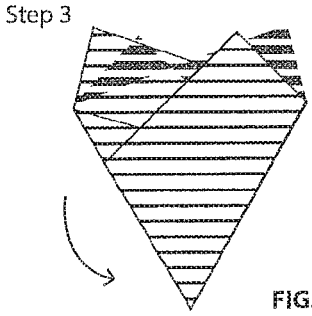

As mentioned above the at least two connected or connectable parts 2, 3 are foldable towards each other along said straight line or region 4 so as to arrange that the two connected parts 2, 3 will partly overlap each other. It is preferred that after the two connected or connectable parts 2, 3 are being folded against each other, said connected parts 2, 3 are further foldable by one or more further folds. With reference to the first embodiment of the wrapping material 1 as depicted in FIG. 1A this is shown in FIG. 1C corresponding to one further fold only. With reference to the second embodiment of the wrapping material 1 as depicted in FIG. 2A, this is shown in FIGS. 2C and 2D respectively. This relates to two subsequent folds. Each further fold applied after folding the two parts 2, 3 together, occurs along a virtual line 8 or region symmetrically dividing the wrapping material in a left part and a right part, wherein after the fold is completed said left part and said right part are overlapping each other. This is clear for the skilled person from what is shown in FIGS. 1C, 2C and 2D respectively. After completion of the final fold neighbouring edges 5 of the adjacent left part and right part are sealed to each other. See FIG. 1D for the first embodiment and FIG. 2E for the second embodiment. Sealing can be affected in many ways for instance by heating, gluing or by ultrasonic sealing.

Figure 2E:
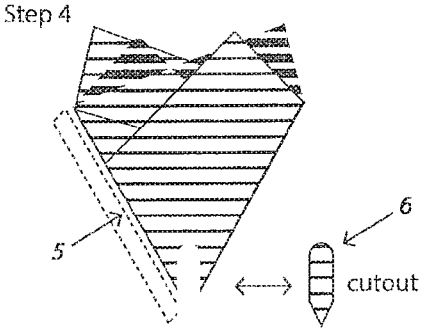

Finally, FIG. 1D for the first embodiment, and FIG. 2E for the second embodiment depict that the wrapping material 1 is provided with a cutout 6 by removal of material of the connected parts.

Although the invention has been discussed in the foregoing with reference to two exemplary embodiments of the wrapping material of the invention, the invention is not restricted to these two embodiments which can be varied in many ways without departing from the gist of the invention. The discussed exemplary embodiments shall therefore not be used to construe the appended claims restrictively and strictly in accordance therewith. On the contrary the embodiments are merely intended to explain the wording of the appended claims without intent to limit the claims to these exemplary embodiments. The scope of protection of the invention shall therefore be construed in accordance with the appended claims only, wherein a possible ambiguity in the wording of the claims shall be resolved using these exemplary embodiments.

What is claimed is:

1. Flexible wrapping material (1) for wrapping flowers and/or plants, comprising at least two connected or connectable parts (2, 3) having mutually distinctive shapes bordering next to each other along a straight line or region (4) separating said parts (2, 3) from each other;

wherein said parts (2, 3) are provided with mutually distinctive prints on said parts (2, 3) and/or said parts (2, 3) are provided with different optical properties and/or said parts (2, 3) are embodied in mutually different materials;

wherein the at least two connected or connectable parts (2, 3) are folded towards each other along said straight line or region (4), which straight line or region (4) is arranged such that after folding the two connected or connectable parts (2, 3) together, said connected or connectable parts (2, 3) at least partly overlap each other;

wherein after the two connected or connectable parts (2, 3) are being folded against each other, said connected or connectable parts (2, 3) are further folded by one or more further folds, each further fold occurring along a virtual line symmetrically dividing the wrapping material in a left part and a right part, wherein after any such fold is completed said left part and said right part are neighbouring to each other, and that after completion of the final fold neighbouring edges (5) of the adjacent left part and right part are sealed to each other.

2. Flexible wrapping material (1) according to claim 1, characterized in that the shapes of the connected or connectable parts (2, 3) are distinctive so as to arrange that after their folding together, the parts (2, 3) only partly overlap.

3. Flexible wrapping material (1) according to claim 1, characterized in that one part is embodied in a plastic material and the other part is embodied in a woven or nonwoven fabric material.

4. Flexible wrapping material (1) according to claim 1, characterized in that after the final fold is completed said left part and said right part are substantially on top of each other.

5. Flexible wrapping material according to claim 1, characterized in that it is provided with a cutout (6) by removal of material of the connected or connectable parts (2, 3).

* * * * *